United States Patent [19]

Nomura et al.

[11] 4,185,910

[45] Jan. 29, 1980

[54] PHOTOCONDUCTIVE MEMBER CLEANING DEVICE USING A MAGNETIC BRUSH FOR ELECTROSTATIC COPYING MACHINES

[75] Inventors: Yutaka Nomura, Yokohama; Mitsuaki Koyama, Kurume, both of Japan

[73] Assignee: Tokyo Shibaura Electric Co., Ltd., Kawasaki, Japan

[21] Appl. No.: 847,051

[22] Filed: Oct. 31, 1977

[30] Foreign Application Priority Data

Jun. 30, 1976 [JP] Japan ..... 51-77403
Jun. 30, 1976 [JP] Japan ..... 51-77404

[51] Int. Cl.[2] ..... G03G 21/00

[52] U.S. Cl. ..... 355/15; 15/256.52; 118/652

[58] Field of Search ..... 355/15, 3 DD; 15/1.5, 15/256.51, 256.52; 118/652, 657, 658

[56] References Cited

U.S. PATENT DOCUMENTS

| | | | |
|---|---|---|---|
| 3,647,293 | 3/1972 | Queener | 355/15 |
| 3,914,045 | 10/1975 | Namiki et al | 355/15 |
| 4,003,651 | 1/1977 | Hashida | 355/15 |

OTHER PUBLICATIONS

*Eastman Kodak Research Disclosure,* "Improved Magnetic Brush Cleaning System," Oct. 1974, p. 44.

*Primary Examiner*—R. L. Moses
*Attorney, Agent, or Firm*—Cushman, Darby & Cushman

[57] ABSTRACT

In a photoconductive member cleaning device in which a magnetic brush is commonly used for development and cleaning, a low bias voltage preventing toner from attaching from the magnetic brush to the photoconductive member is applied to the magnetic brush when cleaning is performed.

14 Claims, 9 Drawing Figures

PHOTOCONDUCTIVE MEMBER CLEANING DEVICE USING A MAGNETIC BRUSH FOR ELECTROSTATIC COPYING MACHINES

BACKGROUND OF THE INVENTION

The present invention relates to a photoconductive member cleaning device used in an electrostatic copying apparatus and, more particularly, the cleaning device using a magnetic brush.

It is common at present that a magnetic brush be used in the development and cleaning in an electrostatic copying apparatus. The electrostatic copying apparatus using the magnetic brush is disclosed in U.S. Pat. No. 2,911,330, and Japanese Patent Disclosure Gazettes Nos. 11538/72 and 11539/72. Such electrostatic copying apparatuses are deficient in that the cleaning effect by the magnetic brush is insufficient.

SUMMARY OF THE INVENTION

The cause giving rise to such a poor cleaning effect was carefully investigated by the inventors of the present application. Through this investigation, it was found that the cleaning effect by the magnetic brush depends largely on a cleaning bias voltage applied to the magnetic brush and the kinds of developer (particularly the quantity of toner charge) and the period of developer use.

A primary object of the present invention is to provide a photoconductive member cleaning device using a magnetic brush by which the cleaning effect is markedly improved, the invention being made on the basis of the fact found during the above mentioned investigation.

According to the present invention, there is provided a photoconductive cleaning device by which a bias voltage is applied to the magnetic brush at such a level that the toner is prevented from attaching from a magnetic brush to a photoconductive member at the cleaning.

DETAILED DESCRIPTION OF THE PREFERRED EMBODIMENTS

Before preceeding with the description of the present invention, the relation will be given between the bias voltage applied to a magnetic brush in the cleaning of a photoconductive member and the quantity of charge on the used toner.

Figure 1:
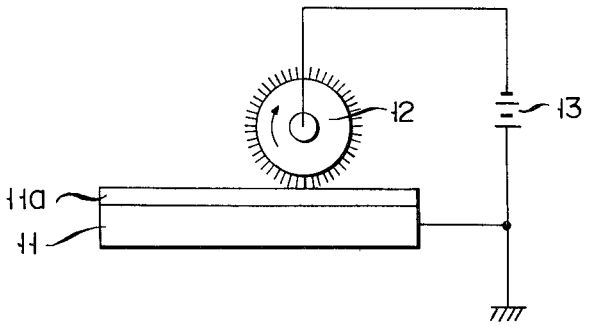
FIG. 1 shows schematically a cleaning device for an electrostatic copying apparatus.
Figure 2:
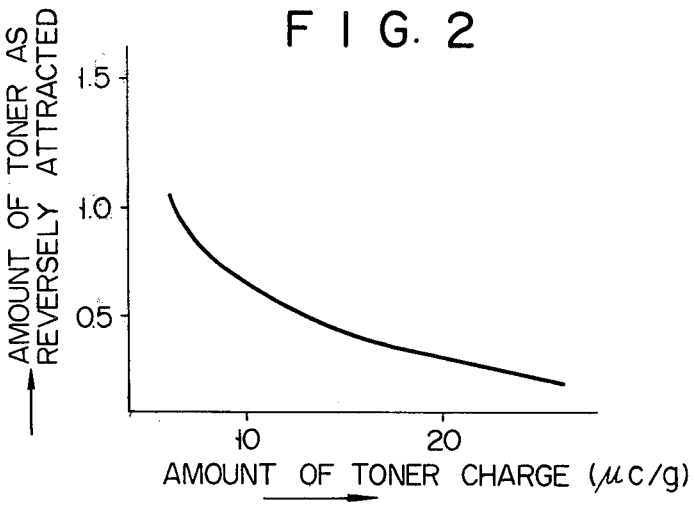
FIG. 2 shows a graph showing the relation of the quantity of toner charge to the amount of inversely (reversely) attaching toner.
Figure 3:
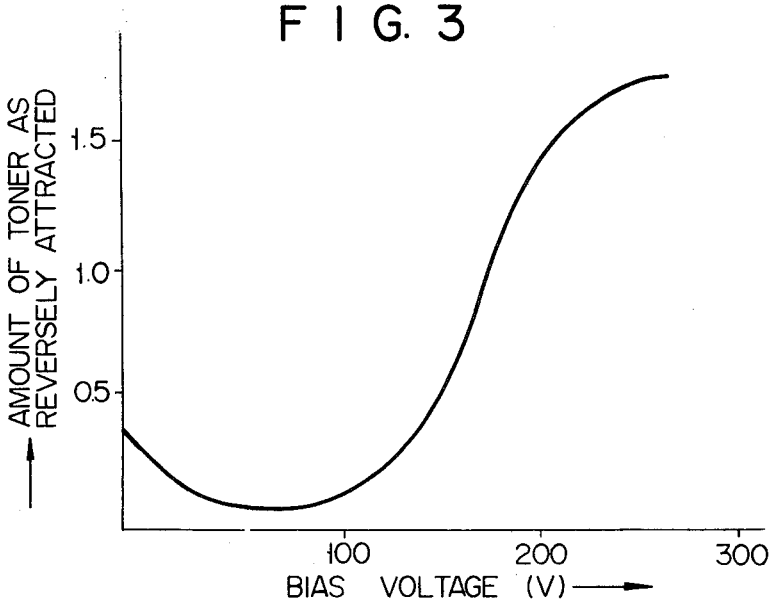
FIG. 3 shows a graph illustrating the relation between bias voltage applied to a magnetic brush at the cleaning and the amount of the inversely attaching toner.
Figure 4:
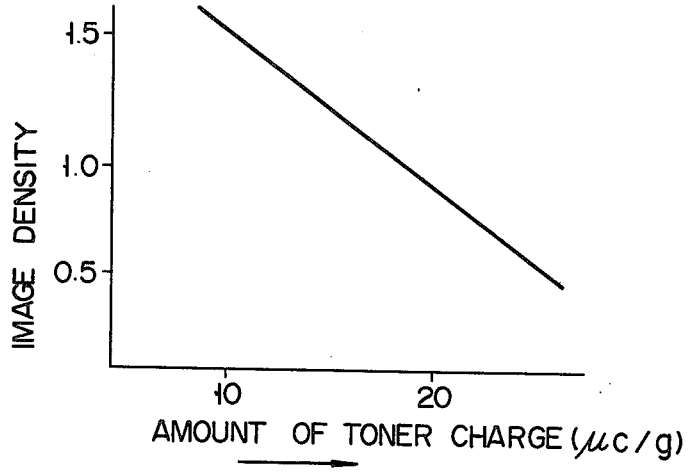
FIG. 4 shows a graph illustrating the relation of the quantity of toner charge to the image density.

Referring now to FIG. 1, there is shown a schematic representation of a cleaning device of an electrostatic copying apparatus for cleaning the surface of a photoconductive member 11, i.e. a photoconductive layer 11*a*, by a magnetic brush 12. In such a cleaning, the magnetic brush is biased with a bias voltage fed from a bias source 13 and having the same polarity as the electrostatic latent image formed on the surface of the photoconductive layer 11*a*. It is well known that the cleaning of the photoconductive layer is more effective as the cleaning bias voltage is higher, since a higher cleaning bias voltage more intensively attracts the toner on the photoconductive layer. However, nobody knows the following fact. A correlation between the bias voltage and the quantity of the toner charge gives rise to a phenomenon that toner on the magnetic brush inversely (reversely) attaches to the photoconductive surface. Because of this phenomenon, the photoconductive layer is incompletely cleaned by the magnetic brush. The inventors of this invention found and took notice of this fact and have developed a cleaning apparatus of the electrostatic copying apparatus. In studying the inversely attaching phenomenon of the toner, data traced in FIGS. 2 to 6 were measured. The graph shown in FIG. 2 illustrates the relation of the amount of the inversely attaching toner to toner charge quantity. The toner charge quantity was measured by the blow-off method. The graph of FIG. 3 shows the relation of the amount of the inversely attaching toner to the bias voltage applied in the cleaning operation. The measurement for obtaining the FIG. 3 graph was conducted in the following manner. With the photoconductive layer in an uncharged condition, the cleaning bias voltage applied to the magnetic brush was gradually increased. The toner quantity inversely attaching onto the surface of the photoconductive surface at any corresponding cleaning bias voltage was determined through the optical measurement of the reflective density on the photoconductive surface.

As seen from FIGS. 2 and 3, the amount of the inversely attaching toner decreases as the toner charge quantity increases but increases as the cleaning bias voltage increases. It is thought that such inversely attaching of the toner results from the following cause. When the bias voltage is applied to the magnetic brush 12, the toner is sandwiched between the magnetic brush formed on the surface of the magnetic brush unit, i.e. the carrier included in the developing powder, and the photoconductive layer 11*a*. In other words, the toner is placed in the electric field formed by a potential difference between the magnetic brush and the photoconductive member. Under this condition, when the bias voltage exceeds a predetermined value, charges are injected from the carrier forming the magnetic brush into the toner. With progression of the charge injection, the polarity of the bias voltage gradually approaches the polarity of the toner. The rate of the polarity change is proportional to the applied voltage, i.e. the bias voltage, and the polarity tends to change as the quantity of toner charge becomes smaller. When the toner polarity becomes equal to the bias voltage polarity, the toner and the carrier tend to repel each other, resulting in the inversely attaching of the toner. This discussion is the result of our study made by the following motive. The experiment shows that little toner with inverse polarity is included in the developer immediately after the cleaning device is adjusted. Accordingly, there must be some cause to produce the toner with inverse polarity.

Figure 5:
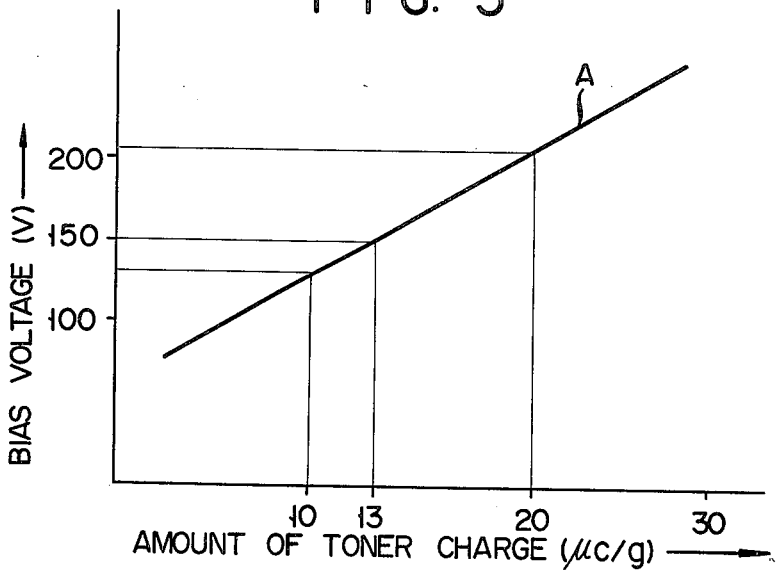
FIG. 5 shows a graph illustrating the relation of the quality of toner charge to the optimum cleaning bias voltage.

As seen from the data in FIGS. 2 and 3, in order to reduce the amount of the inversely attaching toner, it must increase the toner charge quantity and/or it must decrease the potential difference between the magnetic brush and the photoconductive member or the bias voltage applied to the magnetic brush. However, when the toner charge quantity is increased, the image density at the development is reduced, as seen from the FIG. 4 graph. Further, when the decrease of the cleaning bias voltage is too much, the magnetic attraction of the magnetic brush is reduced so that residual toner is incompletely removed, thereby resulting in insufficient cleaning of photoconductive member. Therefore, when the toner charge quantity and the bias voltage are decided, these factors, i.e. the image density and the residual toner, must be taken into consideration. FIG. 5 shows the relation between the cleaning bias voltage and the toner charge quantity from which it may be determined in what region the inversely attaching phenomenon of toner is found. In the figure, the region below a continuous line A prevents the toner from inversely attaching. That is, the inversely attachment of toner does not occur with 200 V or less of the bias voltage in case of using the toner having the charge quantity of 20 μc/g is used. If toner with the charge quantity of 10 μc/g, the bias voltage must be 130 V or less. Otherwise, the inversely attaching occurs. When account is taken of the image density, it is preferred to use the toner having the charge quantity of less than 20 μc/g and preferably 5 to 15 μc/g. For example, if the toner used has the charge quantity of 13 μc/g, the cleaning bias voltage is set at 150 V or less. When the removal of the residual toner mentioned above is considered, it is preferred that the bias voltage is set at the maximum value permitting no inversely attaching of the toner to take place.

Figure 6:
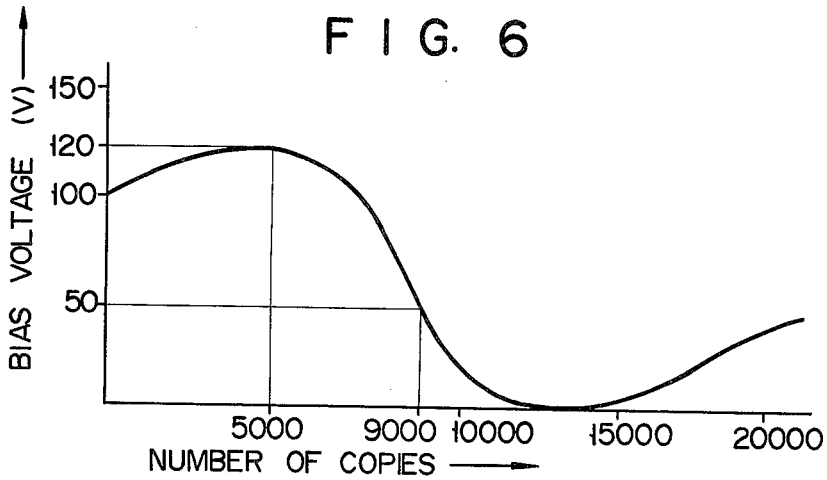
FIG. 6 shows a graph showing the relation of the permissible number of copies to be made and cleaning bias voltage.

In the description thus far made, the cleaning bias voltage was described as being related to only the image density and the removal of the residual toner. However, note that the bias voltage must be selected considering another factor, the life of the toner. Here, the life of the toner means how many copies may be made having the permissible image density. The permissible number of copies depends largely on the cleaning bias voltage. The relation of the permissible number of copies to the optimum cleaning bias voltage is shown in FIG. 6. The graph shows that the permissible number of copies decreases with increasing cleaning bias voltage. For example, the permissible copies are about 5,000 copies at a cleaning bias voltage of 120 V, and about 9,000 copies at 50 V, as shown in the graph. Thus, when the life of the developer, i.e. the permissible number of copies, is taken into consideration, the lower the cleaning bias voltage the better. As previously mentioned, however, the lower the bias voltage the less the removal of the residual toner. Therefore, when these factors are all taken into account, a charge quantity approximately 10 μc/g and a cleaning bias voltage between 70 V and 80 V are desirable. It will be understood that the data illustrated in FIGS. 2 to 6 depend largely on ambient conditions, particularly humidity.

The explanation to follow covers some embodiments of the magnetic brush cleaning device prepared on the basis of the above-mentioned thought.

Figure 7:
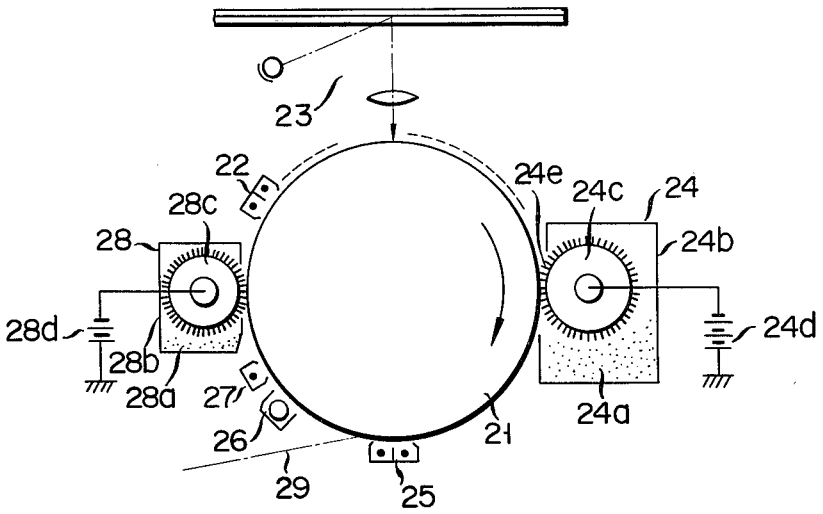
FIG. 7 shows a schematic diagram of a one revolution one copy type electrostatic copying apparatus using an embodiment of the present invention.

In the embodiment shown in FIG. 7, there are successively disposed around a photoconductive drum 21, a charger 22, an exposing means 23, a developing device 24, a transfer device 25, a charge removal exposing device 26, a charge removal charger 27 and a cleaning device 28. The successive disposition of them is made in the rotational direction of the drum. In the thus constructed electrostatic copying apparatus the charger 22 and the transfer device 25 are comprised of corona dischargers each charged at −550 V. The developing device 24 is comprised of a container **24*b* containing developer 24*a*, a magnetic drum 24*c* provided close to the photoconductive drum 21 in the container 24*b*, and a bias source 24*d* for applying the bias voltage to the magnetic drum 24*c*. The cleaning device 28 has a similar construction to the developing device 24. That is, it is comprised of a container 28*b* for containing used toner 28*a*, a magnetic brush drum 28*c* and a bias source 28*d***.

The operation of the thus constructed electrostatic copying apparatus will be given below. In the explanation, used is a developer composed of toner consisting of carbon black 10% and charge controlling pigment 3% in epoxy resin and carrier comprised of 200 to 300 meshes iron powder consisting of a great number of particles whose surfaces are oxidized. The toner and the iron powder are mixed in the proportion of 30 g to 1,000 g and the toner is charged up to a quantity of about 13 μc/g. In operation, a copy commencing switch (not shown), or a start switch, is depressed. Upon the depression of the start switch, the photoconductive drum 21 rotates in the arrow direction while at the same time a voltage of −550 V is applied to the charger 22. With this voltage application, the surface of the photoconductive member is charged to a negative potential. Then, the photoconductive surface is exposed by the exposing device 23 to form an electrostatic latent image on the photoconductive member surface. The latent image is developed by the developing device 24. In the development, the bias voltage source **24*d* applies the developing bias voltage of −200 V to the magnetic brush drum 24*c* of the developing device 24. The magnetic brush 24*e* formed on the magnetic brush drum 24*c* causes the toner to cling onto the latent image on the photoconductive drum, to visualize the latent image. The toner image is transferred onto a copy sheet 29 by the transferring device 25. After this transfer, the photoconductive member surface with residual toner is entirely exposed by the charge removal exposing device 26 for charge removal and the surface, together with residual toner, is charged to a positive polarity by the DC plus charger 27. After this positive polarity charging, the photoconductive member surface is cleaned by the cleaning device 28. In this case, the magnetic brush drum 28*c* of the cleaning device has been biased −100 V being lower than the bias voltage of the developing device, say, −200 V, by the bias voltage source 28*d***. The use of the magnetic brush biased by such a low voltage, i.e. −100 V, for cleaning the photoconductive surface may remove the residual toner without being accompanied by the inversely attaching phenomenon of toner, ensuring good cleaning, as mentioned above.

The above-mentioned embodiment relates to the electrostatic copying apparatus of the type in which all the copying steps, charging, exposure, development, transfer, charge removal, and cleaning, are made in one revolution of the photoconductive drum, and the developing device and the cleaning device are separately provided. However, the present invention may be applied to the electrostatic copying apparatus of the type in which two revolutions of the photoconductive drum are necessary for one copying cycle. Such a type of copying apparatus embodying the present invention will be described with reference to FIG. 8. As shown, a charger-transfer device 32, an entire exposure device 13 for charge removal, an exposure device 34, a DC plus charger 35 and a developing-cleaning device 36 are disposed around a photoconductive drum 31 in its rotational direction. The charger-transfer device 32 has two functions of charging and transferring. That is, it serves as a charger in the first revolution of the photoconductive drum 31 and as a transferring device in the second revolution thereof. Likewise, the developing-cleaning device 36 acts as a developing device in the first revolution of the photoconductive drum 31 and as cleaner in the second revolution. The developing-cleaning device 36 is provided with a switch means 37 for switching a bias voltage source **36*d* for applying to a magnetic brush drum 36*c*** a bias voltage. The bias voltage at the cleaning stage is lower than at the developing stage.

When this type copying apparatus is driven, the charge-transfer device 32 is charged −550 V in the first revolution of the photoconductive drum 31 so that the surface of the photoconductive drum 31 is charged with negative static-electricity. The surface of the photoconductive drum 31 is exposed by an exposure means 34 to form an electrostatic latent image thereon corresponding to an image of a document. The electrostatic latent image is visualized when it passes the developing-cleaning device. At this time, a magnetic brush **36*c* of the developing-cleaning device is biased −200 V by the bias voltage source 36*d* through a contact a of the switch 37, in order to perform the developing. This causes the magnetic brush 36*e* formed on the surface of the magnetic brush drum 36*c* to fix the developer 36*a* including carrier and toner, as in the FIG. 7 embodiment, contained in the container 36*b* onto the electrostatic latent image on the photoconductive drum surface, thereby to form a toner image on the surface of the drum. The toner image is then transferred onto a copying sheet 38 by the charger-transfer device 32 in the second revolution of the drum. The drum surface after passing the charger-transfer device serving as a transferring device in the second revolution of the drum, is entirely exposed by the exposure device 33 for charge removal to remove residual negative charges. Then, the toner remaining on the drum surface is positively charged by the DC plus charger 35 and then the positively charged residual toner is removed from the drum surface by the negatively biased developing-cleaning device. At this time, the developing-cleaning device 36 performs the cleaning operation without being accompanied by the inversely attached phenomenon of toner. As a result, the switch 37 is switched to the contact b through which the bias voltage source 36*d* applies a bias voltage which is lower than at the developing stage, say, −100 V, to the developing-cleaning device 36**.

Figure 8:
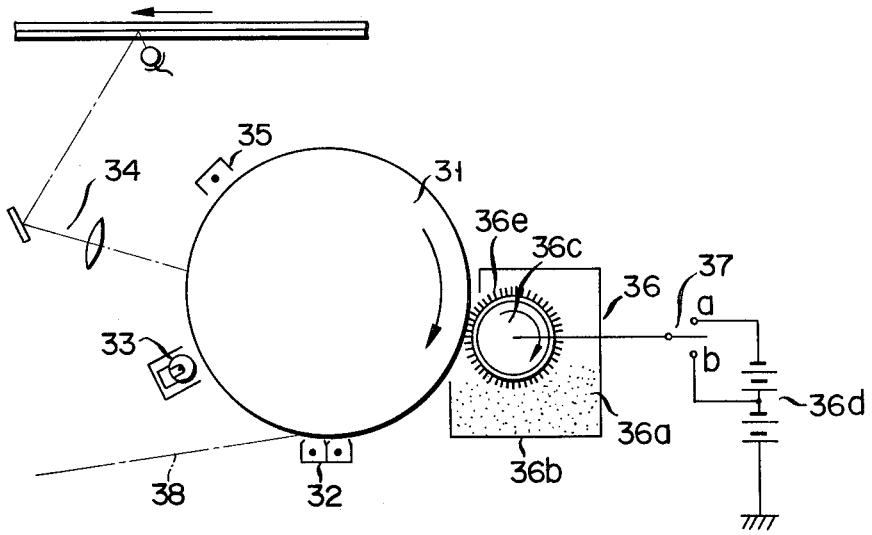
FIG. 8 shows a schematic diagram of a two revolution one copy type electrostatic copying apparatus using another embodiment of the cleaning device according to the present invention.

In the embodiment of FIG. 8, the inversely attaching phenomenon of toner is prevented in such a manner that the bias voltage applied in the second revolution of the drum, i.e. in the cleaning operation, to the magnetic brush is selected lower than in the developing operation. Alternately, the FIG. 8 embodiment may be used in the following manner.

That is, the photoconductive drum is rotated three times for one copying cycle. In the first revolution of the drum, charging, exposure and developing are performed. In the second revolution, transfer, charge removal and cleaning are performed. The steps up to this point is the same as of the FIG. 8 embodiment explanation. Note here that, in this embodiment, at the cleaning stage in the second revolution, a high cleaning bias voltage is applied to the magnetic brush drum to remove the residual toner remaining on the photoconductive drum. In the third rotation of the drum, a low cleaning bias voltage is applied to the magnetic brush drum 36 to remove the toner inversely attaching onto the surface of the drum. With such an arrangement, the residual toner and the inversely attaching toner may be completely removed, improving the efficiency of cleaning.

Figure 9:
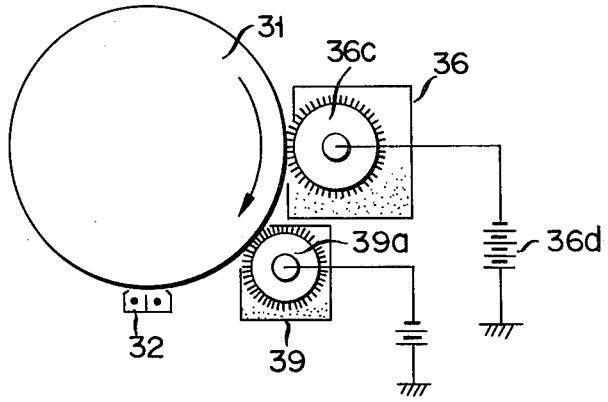
FIG. 9 shows a schematic diagram of a cleaning device which is still another embodiment of the present invention.

In an embodiment of FIG. 9, the bias voltage applied to the magnetic brush drum **36*c* in the developing-cleaning device 36 at the cleaning is equal to that at the developing, the bias voltage being −200 V. During the cleaning under a high bias voltage by the developing-cleaning device, the toner inversely attaching onto the photoconductive drum is removed by the magnetic brush 39*a* provided close to the developing-cleaning device and biased with a low bias voltage, say, −100 V. In the FIG. 9 embodiment, the residual toner is removed by the magnetic brush biased with a high bias voltage so that the cleaning effect of the toner is considerably improved. Furthermore, the inversely attaching toner is removed by an auxiliary cleaning device 39** and therefore the cleaning effect of the photoconductive drum is remarkably improved.

As described above, in the cleaning device according to the present invention, even if toner with a little charge quantity for the purpose of improving the image density is used, since the bias voltage applied to the magnetic brush is low at the cleaning stage, the photoconductive drum may be cleaned without the inversely attaching phenomenon of toner. The low bias voltage elongates the life of the developer i.e. increases the permissible number of copies having the permissible image density.

What we claim is:

1. A cleaning device for removing toner from a photoconductive drum and being used in an electrostatic copying apparatus successively executing charging, exposure for forming a latent image on the surface of the photoconductive drum, development, transfer, charge removal and cleaning during two revolutions of the photoconductive drum, comprising:

magnetic brush means for alternately performing the development and the cleaning during two revolutions of the photoconductive drum; and means for applying during the development in the first revolution of said photoconductive drum to said magnetic brush means a first bias voltage with a given level and with the same polarity as of the electrostatic latent image to be formed on the surface of said photoconductive drum, and for applying during the cleaning in the second revolution of the drum a second bias voltage having the same polarity as that of the electrostatic latent image, said second bias voltage having with a level which is lower than said first bias voltage, said second bias voltage being set at such a level that the potential difference between the second bias voltage and the potential of the photoconductive drum does not cause the polarity of the toner in the magnetic brush means to be reversed and thereby to prevent the toner from being driven away from the magnetic brush means toward the photoconductive drum.

2. A cleaning device according to claim 1 in which the toner is charged less than 20 μc/g.

3. A cleaning device according to claim 1 in which the toner is charged 15 to 5 μc/g.

4. A cleaning device according to claim 1, in which said bias voltage applying means applies 200 V bias voltage at the development and less than 150 V bias voltage at the cleaning.

5. A cleaning device for removing toner from a photoconductive drum which is used in an electrostatic copying apparatus for successively executing charging, exposure for forming a latent image on the photoconductive drum, development carried out with a first magnetic brush means applied with a predetermined first bias voltage having the same polarity as that of the latent electrostatic image, transfer, charge removal and cleaning against the photoconductive drum, comprising:

a second magnetic brush means disposed on a predetermined position of the photoconductive drum along the rotating direction of the photoconductive drum and applied with a second bias voltage having the same polarity as the electrostatic latent image, the second bias voltage being set at such a level that the potential difference between the second bias voltage and the potential of the photoconductive drum does not cause the polarity of the toner in the first magnetic brush means to be reversed and thereby to prevent the toner from being driven away from the first magnetic brush means toward the photoconductive drum.

6. A cleaning device according to claim 5 wherein the second magnetic brush means is supplied with the bias voltage from 0 to 150 V.

7. A cleaning device according to claim 5, in which the toner is charged less than 20 μc/g.

8. A cleaning device according to claim 5, in which the toner is charged 15 to 5 μc/g.

9. A cleaning device for removing toner from a photoconductive member which is used in an electrostatic copying apparatus for successively executing charging, exposure for forming a latent image on the photoconductive member, development, transfer, charge removal and cleaning against the photoconductive member, comprising:

a magnetic brush means for the development and cleaning of said photoconductive member; and means for applying during the development to the magnetic brush means a first bias voltage at a given level and having the same polarity as the electrostatic latent image, and means for applying during the cleaning a second bias voltage of the same polarity as that of the electrostatic latent image and having a level which is lower than the first bias voltage, said second bias voltage being set at such a level that the potential difference between the second bias voltage and the potential of the photoconductive member does not cause the polarity of the toner in the magnetic brush means to be reversed and thereby prevent the toner from being driven away from the magnetic brush means toward the photoconductive member.

10. A cleaning apparatus according to claim 9, in which said bias voltage applying means applies to said magnetic brush the bias voltage from 0 to 150 V.

11. A cleaning device according to claim 2, in which said toner is charged less than 20 μc/g.

12. A cleaning device according to claim 2, in which said toner is charged 15 to 5 μc/g.

13. A cleaning device for removing toner from a photoconductive drum and being used in an electrostatic copying apparatus successively executing charging, exposure, development, transfer, charge removal and cleaning during two revolutions of the photoconductive drum, comprising:

a first magnetic brush means for performing alternately the development and the cleaning during two revolutions of the photoconductive drum; and a second magnetic brush means which is disposed close to said first magnetic brush means at a position advanced in the revolution direction of the photoconductive drum and is biased with a lower voltage than that applied to said first magnetic brush means and removes the toner attaching from said first magnetic brush to said photoconductive drum in the cleaning operation by said first magnetic brush means.

14. A cleaning device for removing toner from a photoconductive drum and being used in an electrostatic copying apparatus for successively executing charging, exposure for forming a latent image on the surface of the photoconductive drum, development, transfer, charge removal, first cleaning and second cleaning during a period of at least three consecutive revolutions of the photoconductive drum, comprising:

magnetic brush means for performing successively the development, the first cleaning and the second cleaning during the three revolutions of the photoconductive drum; and means for applying during the development in the first revolution of the photoconductive drum a first bias voltage to said magnetic brush means, said first bias voltage having a given level and the same polarity as that of the electrostatic latent image, for applying during the first cleaning in the second revolution of the photoconductive drum a second bias voltage substantially equal in level and polarity to the first bias voltage to said magnetic brush means, and for applying during the second cleaning in the third revolution of the photoconductive drum a third bias voltage to said magnetic brush means, said third bias voltage the same in polarity as the first and second bias voltages but lower in level than the first and second voltage whereby said magnetic brush means removes toner attached from said magnetic brush to the photoconductive drum during the first cleaning.

* * * * *